US006941636B2

(12) United States Patent
Dachtler et al.

(10) Patent No.: US 6,941,636 B2
(45) Date of Patent: Sep. 13, 2005

(54) METHOD FOR OPERATING A CASTING-ROLLING PLANT

(75) Inventors: Gerhard Dachtler, Baiersdorf (DE); Thomas Peuker, Baiersdorf (DE); Uwe Stürmer, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/648,574

(22) Filed: Aug. 26, 2003

(65) Prior Publication Data

US 2004/0034987 A1 Feb. 26, 2004

Related U.S. Application Data

(63) Continuation of application No. PCT/DE02/00612, filed on Feb. 20, 2002.

(30) Foreign Application Priority Data

Feb. 26, 2001 (DE) ..... 101 09 223

(51) Int. Cl.[7] ..... B23D 25/00; B23D 11/12

(52) U.S. Cl. ..... 29/527.7; 29/527.5; 164/447

(58) Field of Search ..... 29/527.7, 527.5, 29/33 C, DIG. 5; 164/417, 476, 441; 72/199, 203, 202; 148/541

(56) References Cited

U.S. PATENT DOCUMENTS

| | | | | |
|---|---|---|---|---|
| 4,532,789 | A | 8/1985 | Bruinsma et al. | 72/202 |
| 4,942,656 | A | 7/1990 | Benedetti et al. | 29/527.6 |
| 5,115,547 | A | 5/1992 | Rohde | 29/33 |
| 5,150,597 | A | 9/1992 | Sekiya et al. | 72/229 |

(Continued)

FOREIGN PATENT DOCUMENTS

| | | | |
|---|---|---|---|
| DE | 19529049 | 3/1997 | B22D/11/14 |
| DE | 19839370 | 3/2000 | B21B/1/46 |
| EP | 0196259 | 3/1986 | B01J/19/00 |
| EP | 0524317 | 2/1992 | G05B/13/04 |
| EP | 0 584 605 A1 | 8/1993 | B21B/1/46 |
| EP | 0 665 296 A1 | 1/1995 | C21D/9/00 |
| JP | 57146403 | 9/1982 | B21B/1/00 |
| JP | 57146404 | 9/1982 | B21B/1/00 |
| JP | 57149007 | 9/1982 | B21B/1/46 |
| JP | 58122107 | 7/1983 | B21B/1/46 |
| JP | 61-056705 | 3/1986 | B21B/1/26 |
| JP | 61056705 | 3/1986 | B21B/1/26 |
| JP | 62054501 | 3/1987 | B21B/1/00 |
| JP | 9192706 | 7/1997 | B21B/1/46 |
| WO | WO 00/12235 | 3/2000 | B21B/1/46 |
| WO | 00/33209 | 6/2000 | G06F/17/00 |
| WO | 02/22283 | 3/2002 | B21B/1/46 |

OTHER PUBLICATIONS

W. Rohde (SMS), *Compact Strip Production (CSP): the Approach for Economical Production of Hot Wide Strip*, Revue de Metallurgie XP000449405, pp. 529–540.

International Search Report PCT/DE01/03455.

International Search Report for PCT/DE01/02288.

PCT Written Examination Report for PCT/DE01/02288.

*Primary Examiner*—John C. Hong
(74) *Attorney, Agent, or Firm*—Baker Botts L.L.P.

(57) ABSTRACT

A casting-rolling plant and a method of operating a casting-rolling plant are disclosed. At least one slab production line (40, 50) and at least one mill train (4) as well as at least one slab feeding device (20) that is independent of the slab production line (40, 50) with respect to the production process are provided. In order to achieve a higher throughput in the production of strip material, the slab feeding device (20) takes over slab feed to the mill train (4) during a production break of the slab production line (40, 50) in accordance with logistic and/or manufacturing standards up to a maximum output possible.

8 Claims, 1 Drawing Sheet

U.S. PATENT DOCUMENTS

| | | | | |
|---|---|---|---|---|
| 5,335,713 | A | 8/1994 | Hoppmann et al. | 164/441 |
| 5,519,605 | A | 5/1996 | Cawlfield | 364/151 |
| 5,544,408 | A | 8/1996 | Tippins et al. | 29/527.7 |
| 5,769,152 | A | 6/1998 | Yamada | 164/476 |
| 5,825,645 | A | 10/1998 | Konar et al. | 364/148 |
| 5,991,991 | A | 11/1999 | Pleschiutschnigg | 29/33 |
| 6,026,334 | A | 2/2000 | Kayihan et al. | 700/28 |
| 6,035,682 | A | 3/2000 | Dorigo | 72/204 |
| 6,056,781 | A | 5/2000 | Wassick et al. | 703/12 |
| 6,064,916 | A | 5/2000 | Yoon | 700/44 |
| 6,436,205 | B1 | 8/2002 | Behrens et al. | 148/541 |
| 6,457,227 | B1 | 10/2002 | Nijveld et al. | 29/527.7 |
| 6,463,652 | B1 | 10/2002 | Narushima et al. | 29/527.7 |
| 6,568,056 | B2 | 5/2003 | Sclippa | 29/33 |

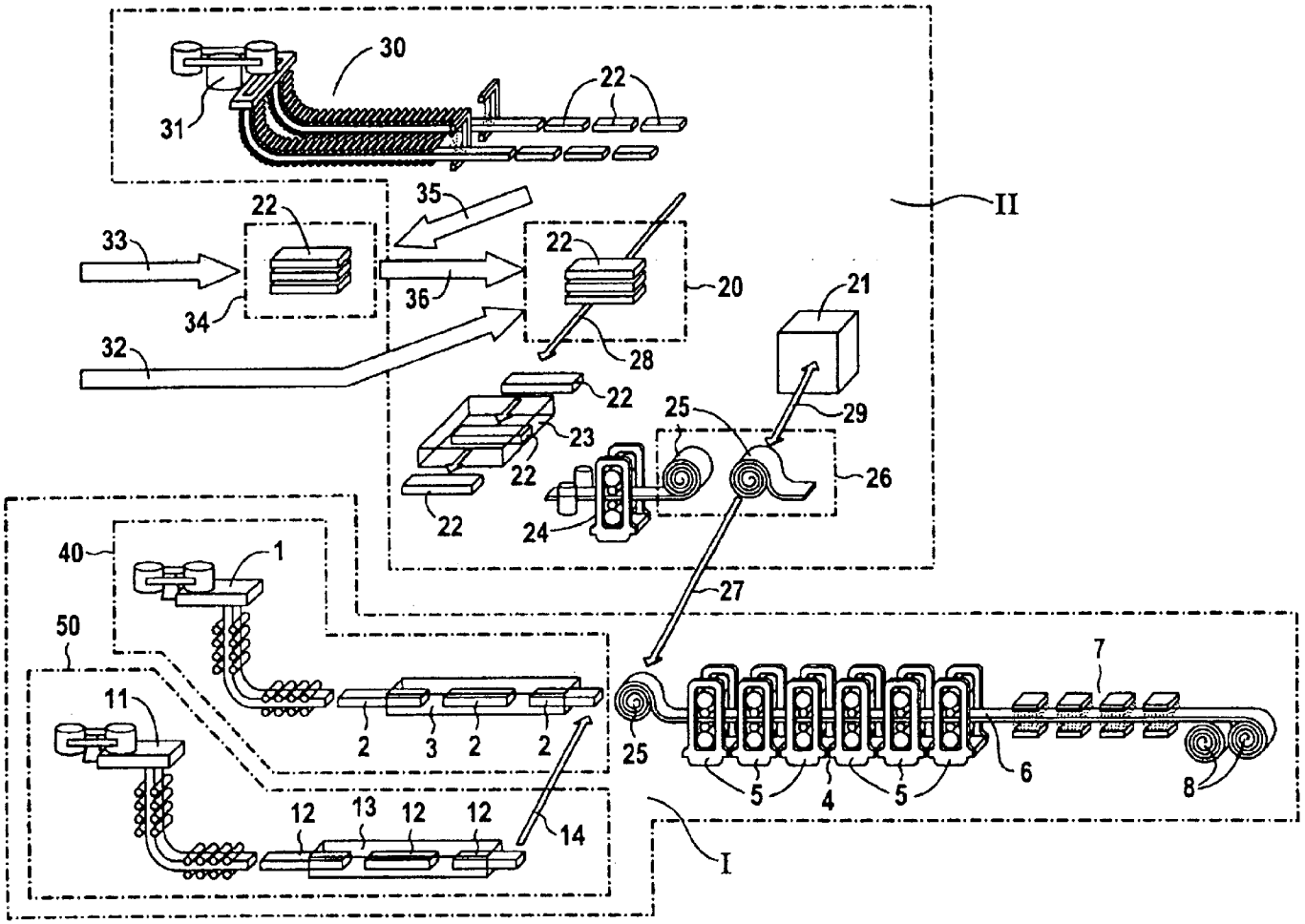
II
I
1
2
3
4
5
6
7
8
11
12
13
14
20
21
22
23
24
25
26
27
28
29
30
31
32
33
34
35
36
40
50

METHOD FOR OPERATING A CASTING-ROLLING PLANT

CROSS REFERENCE TO RELATED APPLICATION

This application is a continuation of copending International Application No. PCT/DE02/00612 filed Feb. 20, 2002, which designates the United States, and claims priority to German application number 10109223.7 filed Feb. 26, 2001.

TECHNICAL FIELD

The invention relates to a method for operating a casting and rolling plant.

BACKGROUND OF THE INVENTION

In casting and rolling plants of this type, slabs are processed to form strip material. The known casting and rolling plants comprise at least one casting machine, the slabs of which are fed to at least one tunnel furnace without being temporarily stored. The tunnel furnace opens out into a rolling mill train (finishing train) with at least one rolling stand. In the rolling mill train, the slabs are rolled to form hot strips. On leaving the rolling mill train, the rolled hot strips are fed to at least one cooling section and are wound up onto at least one coiler.

A casting and rolling plant is therefore characterized by coupling of the processes of slab casting and hot rolling, which are decoupled in conventional steel sheet production. Therefore, steel industry plants comprise at least three components, namely the steel works, in which steel is produced from pig iron, the slab production line, which has at least one casting installation (casting machine with downstream tunnel furnace), and the rolling mill train (finishing train). To maximize production, either two casting installations with in each case one casting strand or one two-strand casting installation is used.

In the known casting plants, the rolling capacity of the rolling mill train cannot be fully exploited over the course of time, since the casting capacity (casting speed and casting cross section) of the casting machine(s) cannot be increased beyond certain limits if technical and quality problems are to be avoided. Despite full casting operation, this means that the rolling mill train rolls more quickly than the casting machine or machines are able to supply slabs.

A further reason for the limited production capacity of the known casting and rolling plants is that the two-strand casting installation or the two casting installations for technical reasons cannot produce at certain times, resulting in gaps in production. The unused production gaps include, inter alia, the necessary idle times of the casting machines caused by the need to change the distributor, mold or segment, planned downtimes for maintenance work and unplanned downtimes caused by problems in casting operation. This means that the rolling mill train then either cannot carry out any rolling at all or can only carry out rolling with increased pauses.

Therefore, the two slab production lines constitute a production bottleneck for the capacity of the rolling mill train, leading to a reduced annual production capacity of the casting and rolling plant.

SUMMARY OF THE INVENTION

Therefore, it is an object of the present invention to provide a method for operating a casting and rolling plant which allows a higher throughput to be achieved during the production of strip material.

According to the invention, the object can be achieved by a method for operating a casting and rolling plant with at least one slab production line, at least one rolling mill train, and at least one slab feed device, which in manufacturing terms is independent of the slab production line, comprising the step of:

during a pause in production of the slab production line, the slab feed device takes over the supply of slabs to the rolling mill train to the maximum feasible extent in accordance with logistical and/or production engineering stipulations.

The object may also be achieved by a method for operating a casting and rolling plant comprising the steps of:

providing at least one slab production line, providing at least one rolling mill train, providing at least one slab feed device, which in manufacturing terms is independent of the slab production line, and during a pause in production of the slab production line, taking over the supply of slabs to the rolling mill train by the slab feed device to the maximum feasible extent in accordance with logistical and/or production engineering stipulations.

The object may yet be achieved by a casting and rolling plant comprising at least one slab production line, at least one rolling mill train, and at least one slab feed device, which in manufacturing terms is independent of the slab production line, and wherein the slab feed device comprises means that during a pause in production of the slab production line, take over the supply of slabs to the rolling mill train to the maximum feasible extent in accordance with logistical and/or production engineering stipulations.

The slab feed device of the casting and rolling plant may receive its slabs from a further slab production line which, together with the slab feed device, is responsible for supplying slabs to the rolling mill train to the maximum feasible extent in accordance with logistical and/or production engineering stipulations. The slab production line of the casting and rolling plant can be designed as a thin-slab production line. The further slab production line can be designed as a thick-slab production line which, together with the slab production line, is responsible for supplying slabs to the rolling mill train to the maximum feasible extent in accordance with logistical and/or production engineering stipulations. The slab feed device of the casting and rolling plant may receive its slabs from a slab store in which prefabricated slabs are temporarily stored for manufacturing purposes.

The method is suitable for operating a casting and rolling plant which comprises at least one slab production line and at least one rolling mill train and also at least one slab feed device which is independent of the slab production line in terms of manufacturing technology. During a pause in production of the slab production line, the slab feed device takes over the supply of slabs to the rolling mill train to the maximum feasible extent in accordance with logistical and/or production engineering stipulations.

Therefore, the invention makes use of previously unused pauses in rolling in the casting and rolling plant by means of optimized logistical conditions in a modified plant configuration which includes a slab feed device.

The invention provides a suitable production planning method which is matched to the nature of the widened configuration of the casting and rolling plant. The slabs supplied by the slab feed device are additionally rolled in the rolling mill train without the basic equipment of the specially configured casting and rolling plant having to be changed. This allows the quantitative throughput during the production of strip material to be significantly increased.

In the context of advantageous configurations of the method according to the invention, the slab feed device, which according to the invention is independent of the slab production line in terms of manufacturing technology, can receive its slabs, for example, from a further slab production line. The further slab production line, together with the slab feed device, is responsible for supplying slabs to the rolling mill train to the maximum feasible extent in accordance with logistical and/or production engineering stipulations.

The further slab production line may be designed as a thick-slab production line which, together with the slab production line, is responsible for supplying slabs to the rolling mill train to the maximum feasible extent in accordance with logistical and/or production engineering stipulations.

According to a further advantageous configuration, the method according to the invention is also suitable for casting and rolling plants which receive their slabs from a slab store in which prefabricated slabs are temporarily stored for production purposes.

The further thin-slab production line may, for example, comprise a further casting machine, which includes a casting strand and a suitable widening of the slab guide mechanism in the tunnel furnace for supply to the rolling mill train. This configuration will be selected if it is intended to produce steel grades which are able to withstand high casting speeds, i.e. standard steels.

An additional conventional slab production line, which rolls thick slabs, by means of at least one heating furnace and by means of at least one (reversing) roughing stand, to form thin slabs and provides the latter to the rolling mill train via a holding furnace. This configuration will be selected if the additional slab production line is to produce steel grades which are not able to withstand high casting speeds, i.e. for example special steels. Therefore, a casting and rolling plant which is operated using the method according to the invention can supply standard steels and special steels with a high total annual production.

Therefore, in the case of the method according to the invention, it is merely important for slabs to be supplied to the slab feed device of the casting and rolling plant according to logistical and/or production engineering stipulations. Therefore, the nature of the further slab production line is of no particular relevance.

The invention generates optimized production plans for operation of the casting and rolling plant with full loading of the rolling mill train.

The plant plans for the individual plant parts of the casting and rolling plant can be determined from production plans of this type. These include melting plans, casting plans and slab deployment plans and rolling plans.

The required melting sequences in at least one steel works assigned to the casting and rolling plant are produced using the melting plans, specifically including the temporal sequence for supplying the molten materials to the casting machines at the correct time.

The casting plans describe the production of the thin slabs in the casting machines of the casting and rolling plant or in the conventional casting machine of the further slab production line, including the casting sequence, the melting sequence and the slab sequence for each slab production line.

The slab deployment plans determine the deployment of the slabs in the further slab production line according to cold, warm or hot use. In this context, in particular the order and the temporal sequence are to be planned in such a way that the slabs are available at the rolling mill train in good time in order to exploit previously unused rolling pauses in the casting and rolling plant.

On account of the rolling plans, the rolling of the slabs from all slab production lines, including cycling of the slab deployment from the tunnel furnace of the casting and rolling plant, is planned in such a manner that the rolling pauses can be put to good use by means of the further slab production line. Moreover, the roll change required in the rolling mill train is planned so as to take account of the buffer times in the furnaces.

Absolute and advisory restrictions (technical rules) are to be taken into account in all planning steps. Absolute restrictions have to be complied with under all circumstances, where advisory restrictions can be optimized by what are known as cost functions. This not only gives rise to valid production plans which can be executed, but also to cost-optimized and throughput-optimized production plans.

BRIEF DESCRIPTION OF THE DRAWINGS

One exemplary embodiment of the method according to the invention is explained in more detail below on the basis of a casting and rolling plant which is diagrammatically depicted in the drawing.

In the drawing, I denotes a first production line. The first production line I comprises a casting machine 1, in which thin slabs 2 are cast. These thin slabs 2 are fed to a tunnel furnace 3. The casting machine 1 and the tunnel furnace 3 together form a slab production line 40 (casting installation). The tunnel furnace 3 opens out into a rolling mill train 4, which in the exemplary embodiment illustrated includes six rolling stands 5. In the rolling mill train 4, the thin slabs 2 are rolled to form hot strips 6. On leaving the rolling mill train 4, the rolled hot strips 6 are fed to a cooling section 7 and wound up onto a coiler 8.

DETAILED DESCRIPTION OF THE PREFERRED EMBODIMENTS

In the case of the casting and rolling installation illustrated in the drawing, the first production line I comprises a further casting machine 11. In manufacturing technology terms, the casting machine 11 is arranged parallel to the casting machine 1. The casting machine 11 likewise produces thin slabs 12. These thin slabs 12 are fed to a tunnel furnace 13 which is arranged within the first production line I, parallel with the tunnel furnace 3 in terms of manufacturing technology. The casting machine 11 and the tunnel furnace 13 together form a slab production line (casting installation), which is denoted by 50. The thin slabs 12 produced by the slab production line 50 are then likewise fed to the rolling mill train 4 (arrow 14).

The slab production lines 40 and 50 together form a two-strand casting installation.

A second production line II is arranged at least partially in parallel, in terms of manufacturing technology, with the first production line I. In the case of the casting and rolling installation illustrated, the second production line II comprises a slab feed device 20. This slab feed device 20 can be used to feed the slabs 22 to a reheating furnace 23 and a downstream (reversing) roughing stand 24. The roughened strips rolled in the roughing stand 24 are received as coils 25 by a coil box 26.

In the method according to the invention, the slab feed device 20 is controlled independently, in terms of manufacturing technology, from the slab production line 40 or 50.

The casting and rolling installation also comprises a coil transport device, by means of which the coils 25, upstream of the rolling mill train 4, are transferred from the second production line II to the first production line I. For reasons of clarity, the coil transport device is not shown in the drawing. To supply the roughed strips, the coils 25 are removed from the coil box 26 and transported to the entry to the rolling mill train 4. The supply of the coils 25 is symbolically indicated by an arrow 27.

In the configuration illustrated in the drawing, the coil box 26 is assigned a holding furnace 21 for storing the coils (double arrow 29).

In addition, the embodiment shown has added to it a slab production line 30. The slab production device 30 is in this case arranged upstream of the slab feed device 20. The slab production line 30 comprises a casting machine 31, in which slabs 22 are cast. These slabs 22 are fed directly to the slab feed device 20 (warm or hot deployment). The slab feed device 20 in turn feeds the slabs 22 to the reheating furnace 23 (arrow 28).

Alternatively, in the embodiment of the slab feed device 20 illustrated in the drawing, it is possible to supply externally produced slabs (cold deployment). The supply of the externally produced slabs is symbolically indicated by an arrow 32.

Both the slabs 22 produced by the slab production line 30 and the externally produced slabs can be temporarily stored, in manufacturing technology terms, in a slab store 34 (arrow 33 or arrow 35) and can be fed to the slab feed device 20 as required (arrow 26, cold deployment).

What is claimed is:

1. A method for operating a casting and rolling plant comprising the steps of:

providing at least one thin-slab production line consisting of first and second thin-slab casting machines and first and second corresponding tunnel furnaces, providing at least one rolling mill train for said line adapted to receive thin-slabs from the line and thick-slabs, providing at least one slab feed device independent of the thin-slab production line, said device adapted to supply slabs not produced by said thin-slab line in accordance with logistical and/or production engineering stipulations.

2. The method as claimed in claim 1, wherein the slab feed device receives its slabs from a further slab production line which, together with slab feed device, is responsible for supplying slabs to the rolling mill train.

3. The method as claimed in claim 2, wherein the further slab production line is designed as a thick-slab production line which, together with the thin-slab production line, is responsible for supplying slabs to the rolling mill train.

4. The method as claim in claim 1, wherein the slab feed device receives its slabs from a slab store in which prefabricated slabs are temporarily stored.

5. A casting and rolling plant comprising:

a slab production line consisting of first and second casting machines and first and second corresponding tunnel furnaces, a rolling mill train for said line for receipt of slabs produced by the line and slabs not produced by the line, a slab feed device independent of the slab production line, said device adapted to supply slabs not produced by said line to said rolling mill train in accordance with logistical and/or production engineering stipulations.

6. The plant as claimed in claim 5, further comprising a further slab production line, wherein the slab feed device of the casting and rolling plant receives its slabs from the further slab production line.

7. The plant as claimed in claim 6, wherein the further slab production line is designed as a thick-slab production line.

8. The plant as claimed in claim 5, wherein the slab feed device receives its slabs from a slab store in which prefabricated slabs are temporarily stored.

* * * * *